US009937399B1

(12) United States Patent
Peterson

(10) Patent No.: US 9,937,399 B1
(45) Date of Patent: Apr. 10, 2018

(54) SHUTTLECOCK

(71) Applicant: P3 Creativity, LLC, Santa Ana, CA (US)

(72) Inventor: Scott T. Peterson, Santa Ana, CA (US)

(73) Assignee: P3 Creativity, LLC, Santa Ana, CA (US)

( * ) Notice: Subject to any disclaimer, the term of this patent is extended or adjusted under 35 U.S.C. 154(b) by 0 days.

(21) Appl. No.: 15/653,347

(22) Filed: Jul. 18, 2017

(51) Int. Cl.
*A63B 67/18* (2016.01)
*A63B 67/187* (2016.01)

(52) U.S. Cl.
CPC ..... *A63B 67/187* (2016.01)

(58) Field of Classification Search
CPC ..... A63B 67/18; A63B 67/183; A63B 67/187; A63B 67/19; A63B 67/197
USPC ..... 473/579, 580
See application file for complete search history.

(56) References Cited

U.S. PATENT DOCUMENTS 1,393,407 A * 10/1921 Tenney ..... A63B 67/18 473/580
2,354,790 A * 8/1944 Beck ..... A63B 67/183 473/579
2,485,420 A * 10/1949 Timpe ..... A63B 67/187 473/580
2,666,643 A * 1/1954 Miller ..... A63B 67/187 473/580
2,734,746 A * 2/1956 Sametz ..... A63B 67/187 473/579
2,757,932 A * 8/1956 Shaw ..... A63H 5/00 446/400
3,904,205 A * 9/1975 Robinson ..... A63B 67/187 473/579
4,019,738 A * 4/1977 Tong ..... A63H 33/00 473/580
4,305,589 A * 12/1981 Popplewell ..... A63B 67/193 473/579
4,538,818 A * 9/1985 Sinclair ..... A63B 67/193 473/579
4,657,262 A * 4/1987 Buckland ..... A63B 67/19 473/580
4,770,423 A * 9/1988 Pinske ..... A63B 67/183 473/579
4,813,686 A * 3/1989 Miranda ..... A63B 67/183 473/580
5,421,587 A * 6/1995 Mao-Huang ..... A63B 67/187 473/579
5,562,290 A * 10/1996 Wei ..... F21K 2/06 273/DIG. 24
5,853,340 A * 12/1998 Willis ..... A63B 67/187 473/579
5,865,697 A * 2/1999 Molitor ..... A63B 41/00 473/604

(Continued)

*Primary Examiner* — Alexander Niconovich
(74) *Attorney, Agent, or Firm* — Klein, O'Neill & Singh, LLP

(57) ABSTRACT

The present invention provides an improved shuttlecock for use in a racquet sport games. The shuttlecock has a core housing with an upper portion and a lower half round shaped portion secured in a flexible nose cone. Tail fins having strengthened base areas are secured to the core housing. The flexible nose cone has an interior impact cushion zone against which the half round shaped portion rests for absorbing and redistributing forces applied to the nose cone by a racket, or the like.

9 Claims, 3 Drawing Sheets

(56) References Cited

U.S. PATENT DOCUMENTS

| | | | | |
|---|---|---|---|---|
| 6,315,687 | B1 * | 11/2001 | Todd | A63B 67/183 473/579 |
| 6,709,353 | B1 * | 3/2004 | Peterson | A63B 67/18 473/579 |
| 7,258,635 | B2 * | 8/2007 | Brandes | A63B 67/193 473/579 |
| 8,147,359 | B2 * | 4/2012 | Ng | A63B 67/197 473/579 |
| 9,132,328 | B1 * | 9/2015 | Daole | A63B 67/18 |
| 9,192,837 | B2 * | 11/2015 | Nally | F42B 6/003 |
| 9,440,130 | B2 * | 9/2016 | Dai | A63B 67/18 |
| 2006/0061027 | A1 * | 3/2006 | Landi | F16F 7/121 267/195 |
| 2011/0034277 | A1 * | 2/2011 | Brandes | A63B 67/187 473/580 |

* cited by examiner

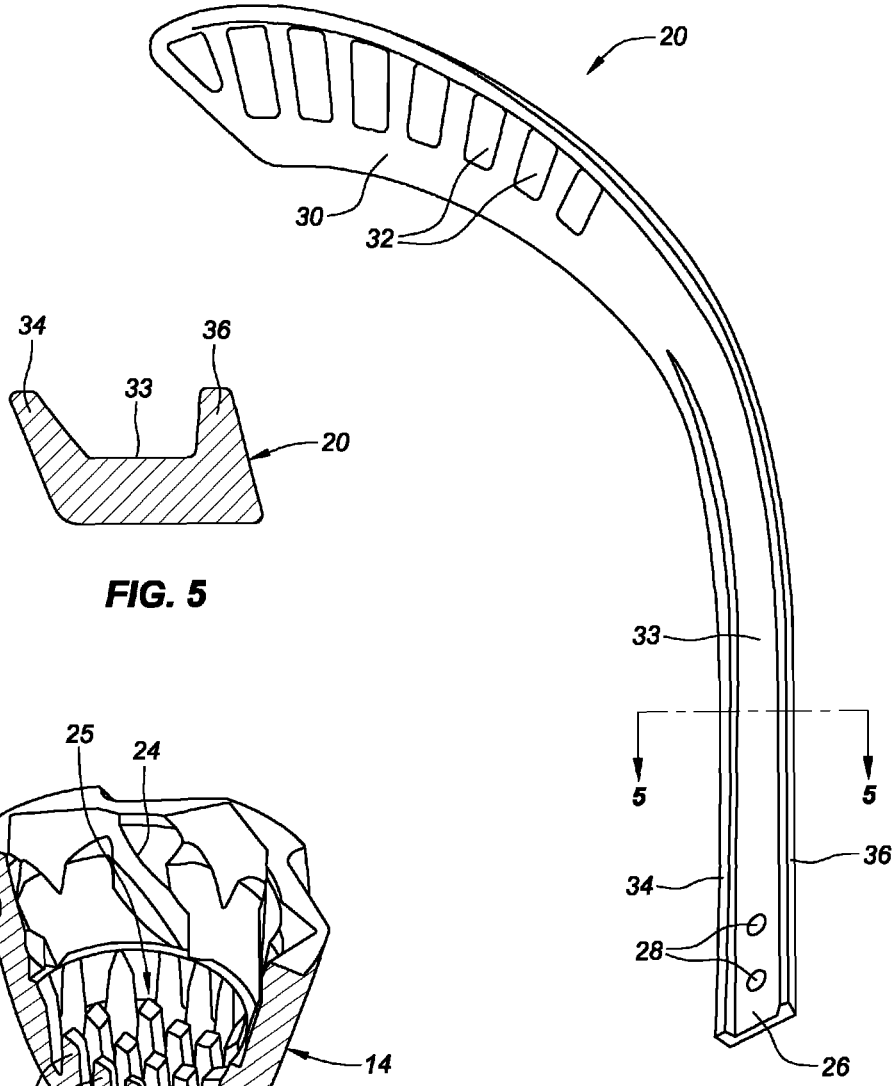
FIG. 4
FIG. 5
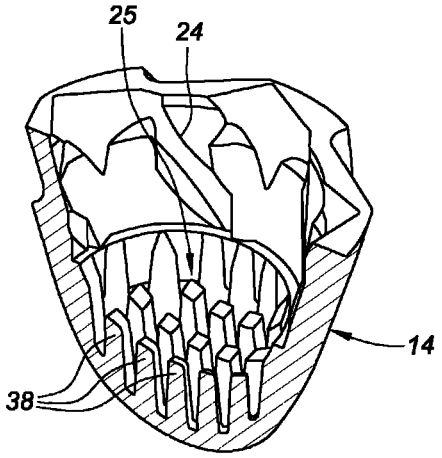
FIG. 6

SHUTTLECOCK

BACKGROUND OF THE INVENTION

1. Field of the Invention

This invention generally relates to shuttlecocks used in racquet sport games and, more particularly, to an improved shuttlecock having strengthened fins and a force absorbing nose cone.

2. Description of the Prior Art

Shuttlecocks for use in conjunction with racquet sport games are known. For example, the inventor herein obtained U.S. Pat. No. 6,709,353, issued on Mar. 23, 2004, for a Racquet Sport Game and Shuttlecocks for Use Therewith ("'353").

While the shuttlecock in the '353 patent provided for an interesting game, it suffered from being too fragile, causing fatigue failure of one or more of the tail fins and other elements of the shuttlecock, after prolonged use. The shuttlecock of the present invention provides an integrated assembly that is more rigid and forgiving and which may be used in a racquet sports game for prolonged periods of time, without failure.

Therefore, there exists a need in the art for a shuttlecock that overcomes known problems by providing a device with strengthened tail fin portions and an improved, partially compressible or flexible nose cone, to absorb energy and redistribute forces applied by a racket, or the like, in accordance with the present invention.

SUMMARY OF THE INVENTION

Accordingly, it is a general object of the present invention to provide an improved shuttlecock assembly. It is a more particular object of the present invention to provide an improved shuttlecock assembly having strengthened tail fins. It is a further object of the present invention to provide an improved shuttlecock assembly having strengthened tail fins releasably secured to a core housing and an improved nose cone holding the core housing. It is yet another object of the present invention to provide an improved shuttlecock assembly having tail fins with strengthened bases or lower sections. It is a still further object of the present invention to provide an improved shuttlecock assembly having tail fins with of raised edges or walls, starting at the base thereof and extending to an upper window section, forming a substantially channel-shaped base portion for added strength. It is yet a still further object of the present invention to provide an improved shuttlecock assembly having a novel nose cone with an interiorly formed waffle impact zone cushion. It is yet another object of the present invention to provide an improved shuttlecock assembly having a novel nose cone with an interiorly formed waffle impact zone cushion area to cushion and absorb forces applied by any impact to the nose cone and distributed to a half round of a core housing, held in the nose cone.

In accordance with one aspect of the present invention there is provided an improved shuttlecock for use in a racquet sport games that includes an assembly having a core housing secured in a nose cone, with strengthened tail fins secured to the core housing and an interior impact zone cushion in the nose cone for absorbing and redistributing forces applied to the shuttlecock by a racket, or the like. The improved shuttlecock of the present invention has an integrated design that provides strengthened tail fins and a cushioned nose cone, which improve stability and contribute to a longer useful life.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

FIG. 4 is a side plan view of a tail fin of the present invention;

FIG. 5 is a cross-sectional view of a tail fin, taken along line 5-5 of FIG. 4; and FIG. 6 is a cross-sectional view of an enlarged nose cone, removed from the core housing, showing details of an interior hollow area and the interior waffle impact zone cushion.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved shuttlecock assembly.

The improved shuttlecock of the present invention may be used in any type of a racquet sport game, for example, in the same manner as described in the sports game set forth in the '353 patent.

Figure 1:
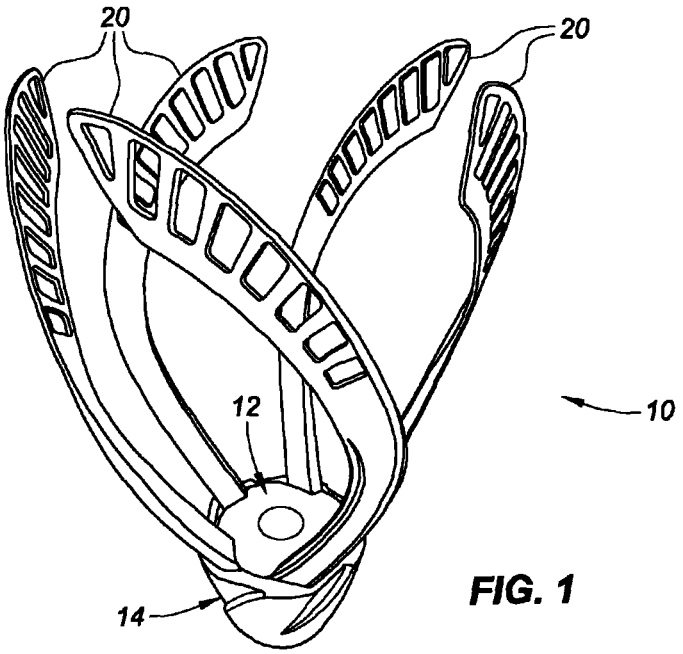
FIG. 1 is a perspective view, looking down from the top of an assembled shuttlecock of the present invention.
Figure 2:
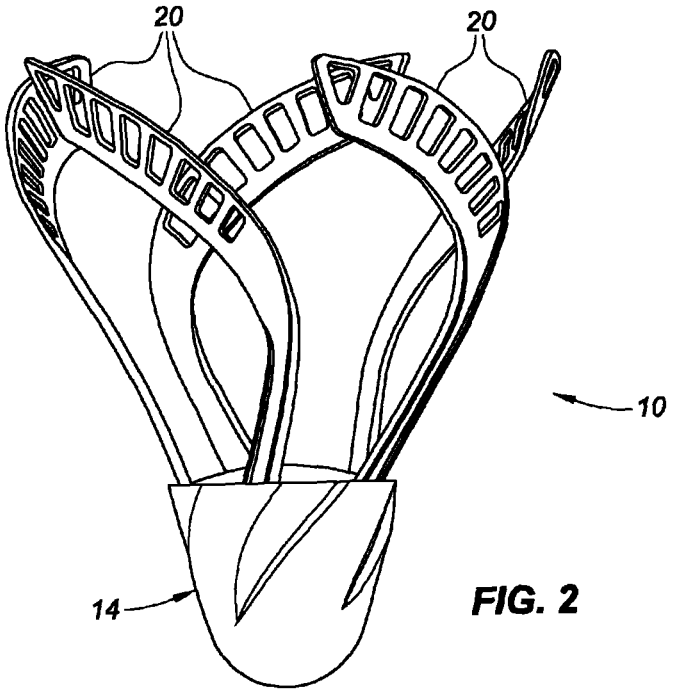
FIG. 2 is a side elevational view of FIG. 1.
Figure 3:
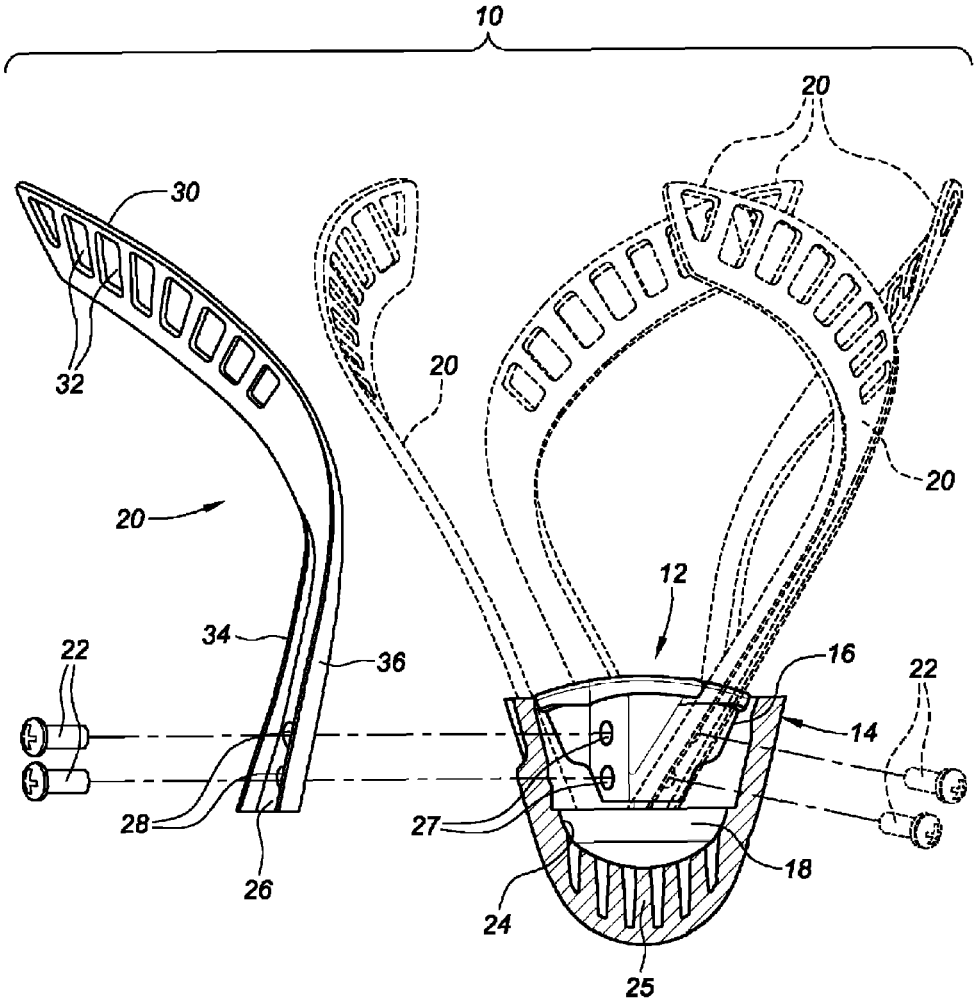
FIG. 3 is a partial, exploded side elevational view of the shuttlecock of FIG. 2, showing the nose cone in cross-section, with one of the tail fins, in solid line, removed from the core housing and the remaining tail fins shown in broken line, secured to the core housing.

Turning now to the drawings, FIGS. 1-3 illustrate a preferred embodiment of a shuttlecock 10 of the present invention. The shuttlecock 10 includes a core housing 12 having a separable nose cone 14 secured over the core housing, as by means of an adhesive or the like. The core housing 12 (see FIG. 3) is comprised of a substantially solid base, which may be one piece or multi-component, having a larger upper portion 16 and a lower half round 18 secured, as by a pin or other securing means, in the larger upper portion. A plurality of tail fins 22 are releasably secured, as by pins or screws 22 to openings 27 formed in the upper portion 16. In the preferred embodiment of the invention the shuttlecock assembly 10 includes five (5) tail fins 20.

The nose cone 14 includes fluted inner and outer surfaces and a hollow inner chamber 24 having a waffle impact zone cushion area or portion 25 formed on the lower interior surface thereof. As best shown in FIG. 3 the hollow inner chamber 24 is sized and dimensioned to snugly hold the core housing 12 when inserted therein, with the lower half round 18 rests against the waffle impact zone cushion area 25 when the shuttlecock is assembled.

The shuttlecock may be of any desired size with its components made from any desired materials. For example, the core housing or base 12 may be made from plastic or a hardened rubber, while the nose cone 14 is preferably made from rubber or another resilient material. And, the tail fins 20 are preferably made from a resilient plastic.

As best shown in FIGS. 3-5, the tail fins 20 include a base or lower portion 26 having one or more openings 28 formed therein through which the securing elements 22 pass, and outer or upper curved window portions 30 having a plurality of openings 32 formed therein. The base or lower portion 26 include raised walls 34, 36 formed at the inner and outer edges on one side or surface 33 thereof to form a channel beam like strengthened or stiffened section at the base 26. As shown, the raised walls 34, 36 extend along the edges of 20 until they terminate at 35 on the inner edge before reaching the openings 32, and taper down or end on the outer edge before the end of the window portions 30.

Turning now to FIG. 6, there shown is a cross-sectional view of the nose cone 14, removed from the core housing, showing in detail that the interior waffle impact zone cushion 25 has a plurality of flexible or resilient teeth or fingers 38 against which the lower half round 18 sits or rests when the nose cone is secured to the core housing 12. It is to be understood that these fingers move or flex when force is applied to the exterior of the nose cone, when secured to the core housing, as shown in FIGS. 1-3.

It, therefore, can be seen that the present invention provides an improved shuttlecock that has tail fins with strengthened base portions and a force absorbing nose cone that provide longer life and allow for more enjoyable and extended play time.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than is specifically described herein.

What is claimed is:

1. An improved shuttlecock for a racquet sports game, comprising;

a base having a nose cone and a core housing held in a hollow inner chamber in the nose cone;

said core housing having an upper portion and a half round lower portion and a plurality of fins forming a tail portion removably secured to and spaced around the core housing; and wherein each of the plurality of fins is substantially identical and include strengthened portions comprised of raised walls extending along edges of one side thereof; and wherein the hollow inner chamber of the nose cone includes a force absorbing element formed in a lower portion of the hollow inner chamber, to flexibly support the half round portion of the core housing.

2. The improved shuttlecock for a racquet sports game of claim 1 wherein the raised walls form a channel like portion.

3. The improved shuttlecock for a racquet sports game of claim 2, wherein the force absorbing element comprises a plurality of flexible fingers providing a waffle pattern formed integrally with the nose cone.

4. The improved shuttlecock for a racquet sports game of claim 3 wherein the nose cone is formed from a resilient material and the flexible fingers are comprised of a plurality of upstanding fingers.

5. An improved shuttlecock for a racquet sports game, comprising;

a base having a flexible nose cone and a substantially non-flexible core housing held in a hollow inner chamber in the flexible nose cone;

said core housing having an upper portion and a half round lower portion with a plurality of tail fins removably secured to and spaced around the upper portion; and wherein the hollow inner chamber of the nose cone includes force absorbing fingers formed in a lower portion of the hollow inner chamber, to flexibly support the half round lower portion of the core housing in the hollow inner chamber.

6. The improved shuttlecock for a racquet sports game of claim 5 wherein each of the plurality of fins is substantially identical and include strengthened portions comprised of raised walls extending along edges of one side thereof to form a channel extending from the base of each fin to at least window areas formed in said fins.

7. The improved shuttlecock for a racquet sports game of claim 6 wherein the raised walls form a channel like strengthening portion on at least the lower portions of each of the tail fins.

8. The improved shuttlecock for a racquet sports game of claim 7, wherein the force absorbing fingers formed in a lower portion of the hollow inner chamber are comprised of a plurality of integral flexible fingers providing a waffle impact zone cushion for the lower half round.

9. An improved shuttlecock for a racquet sports game, comprising;

a base having a flexible nose cone and a substantially non-flexible core housing held in a hollow inner chamber in the flexible nose cone;

said core housing having an upper portion and a half round lower portion secured to the upper portion and a plurality of tail fins removably secured to and spaced around the upper portion by removable pins;

wherein the hollow inner chamber of the nose cone includes a force absorbing element formed in a lower portion of the hollow inner chamber comprised of a plurality of integral flexible fingers providing a waffle impact zone cushion for the lower half round, to flexibly support the half round lower portion of the core housing in the hollow inner chamber; and wherein there are five substantially identical tail fins and each of the tail fins include strengthened portions comprised of raised walls extending along edges of one side thereof to form a channel extending from the base of each tail fin to at least window areas formed at an outer end of each tail fin for strengthening at least the lower portions of each of the tail fins.

* * * * *